US006761467B2

(12) United States Patent
Matthews et al.

(10) Patent No.: US 6,761,467 B2
(45) Date of Patent: Jul. 13, 2004

(54) LIGHT BEAM MODIFIER DEVICES

(75) Inventors: John W. Matthews, Newport Beach, CA (US); Paul Y. Kim, Irvine, CA (US)

(73) Assignee: Surefire, LLC, Fountain Valley, CA (US)

( * ) Notice: Subject to any disclaimer, the term of this patent is extended or adjusted under 35 U.S.C. 154(b) by 68 days.

(21) Appl. No.: 10/113,985

(22) Filed: Apr. 1, 2002

(65) Prior Publication Data

US 2003/0021109 A1 Jan. 30, 2003

Related U.S. Application Data

(60) Provisional application No. 60/308,168, filed on Jul. 25, 2001.

(51) Int. Cl.[7] ..... F21L 4/04

(52) U.S. Cl. ..... 362/202; 362/208; 362/282; 362/396

(58) Field of Search ..... 362/202, 208, 362/282, 322, 319, 396; 285/18, 33, 112, 365, 367; 292/247; 24/270

(56) References Cited

U.S. PATENT DOCUMENTS

| | | | | | |
|---|---|---|---|---|---|
| 3,697,743 | A | * | 10/1972 | Eargle | 362/260 |
| 3,711,702 | A | * | 1/1973 | Adra | 362/345 |
| 3,828,403 | A | * | 8/1974 | Perrin et al. | 24/270 |
| RE37,092 | E | * | 3/2001 | Sharrah et al. | 362/183 |

OTHER PUBLICATIONS

Laser Products, Sure Fire Catalog,"Tactical Light and Laser Sight Product Selection Guide", pp. 13 and 16, 1998.*

* cited by examiner

*Primary Examiner*—Alan Cariaso
*Assistant Examiner*—Mark Tsidulko
(74) *Attorney, Agent, or Firm*—David Weiss

(57) ABSTRACT

A light beam modifier device for attachment to a light beam generator apparatus such as a flashlight or a weapon light. The light beam modifier includes an easily operable clamp for facilitating securement and removal of the light beam modifier device to and from the light generator. The device provides a positive locking closure between the flip-open door and the clamp, and further includes a spring hinge for permitting at least one and preferably two flip-open positions of the door out of the path of the light beam.

44 Claims, 4 Drawing Sheets

LIGHT BEAM MODIFIER DEVICES

CROSS-REFERENCE TO RELATED APPLICATION

This application claims the benefit of U.S. Provisional Patent Application No. 60/308,168, filed Jul. 25, 2001, which provisional application is incorporated herein by reference.

BACKGROUND OF THE INVENTION

This invention relates to light beam modifier devices, and more particularly to light beam modifier devices for attachment to light beam generator apparatus such as flashlights as well as weapon lights including target illuminators and laser sights for firearms.

As used herein, the term "light beam modifier" embraces devices for modifying characteristics of a light beam, including devices for placing optical filters, lenses and diffusers in the path of the light beam for altering the light beam, as well as opaque covers for blocking the light beam. Such light beam modifier devices are generally provided as accessories for flashlights and weapon lights. The filter devices limit the color of white light to produce a blue, red, or infrared light, as examples, depending upon the tactical needs of the user of the flashlight or weapon light. Lenses or diffusers may be employed for producing a broader or more diffused light beam for close-up work or when an intense light focused beam is not desired. An opaque cover may be utilized for blocking the light beam. In any of these modifiers, the light beam may be returned to its unmodified or original condition by removing the filter, lens, diffuser or cover from the path of the light beam.

Conventional light modifier devices generally include a friction fit sleeve of elastic material such as rubber that is twisted onto the front end bezel or head of the light generator, a spring hinged door containing the light modifying material (filter, lens, diffuser or cover), the door being friction held about the front edge of the resilient sleeve and may be flipped open to remove the door from the light path. Such prior art devices may be difficult to be placed onto and removed from the light generator under tactical conditions, and the door is generally subject to being sprung open by being inadvertently touched by the user or by vibration such as when used on a weapon light secured to a firearm.

SUMMARY OF THE INVENTION

Light beam modifier devices according to the present invention resolve the deficiencies of the prior art light beam modifier devices. According to one aspect of a preferred embodiment of the present invention, a light beam modifier device is provided which includes an easily operable clamp for facilitating securement of the light beam modifier device to the light generator and for facilitating removal of the light beam modifier device from the light generator when desired. A further aspect of the preferred embodiment provides a positive locking closure between the flip open door and the clamp, for assuring that the door is maintained in its closed position during tactical operations. According to another aspect of the preferred embodiment, the light modifier device includes a spring hinge that permits at least one and preferably two flip-open positions of the door out of the path of the light beam. The preferred embodiment is watertight when installed on the light generator, and leakage of light from the unmodified beam is precluded.

A preferred embodiment of the present invention provides a device for modifying a light beam emanating from the head of a light beam generator, the device comprising the combination of: a clamp assembly including a substantially tubular member having a front edge and a rear edge and a longitudinal opening defined by longitudinal ends extending between the front and rear edges, a latch on the tubular member across the longitudinal opening and manually operable to a latched position maintaining the width of the opening for clamping the tubular member about the light beam generator head, the latch being manually operable to an unlatched position permitting the width of the opening to be increased for unclamping the tubular member from the light beam generator head; and a door pivotally secured to the clamp assembly and including a light modifier element, the door being pivotable to a closed position placing the light modifier element in the path of a light beam generated by the light beam generator when the tubular member is clamped to the light beam generator head, the door being pivotable to an open position placing the light modifier element out of the path of the light beam when the tubular member is clamped to the light beam generator. The latch across the longitudinal opening is preferably manually operable past the unlatched position for further increasing the width of the longitudinal opening.

In the preferred embodiment, the latch includes a pivot arm having first and second ends, the first end pivotally secured to a first longitudinal pivot pin secured to the tubular member, a finger-actuable member pivotally secured to a second longitudinal pivot pin secured to the tubular member, the first and second longitudinal pivot pins respectively situated on opposite sides of the longitudinal opening, the second end of the pivot arm pivotally secured to a third longitudinal pivot pin carried by the finger-actuable member. The pivot arm preferably describes an arc, the arc radius of the inner surface of the pivot arm being equal to or slightly greater than the radius of the exterior surface of the tubular member.

An elastomeric seal is fitted to the interior surface of the tubular member, the elastomeric seal extending over the tubular member's front edge for sealingly contacting the door when the door is in its closed position.

The preferred light beam modifier device includes a door latch having a manually actuable latching member on the door in cooperative engagement with the clamp assembly for latching the door in its closed position to the clamp assembly. The door latch preferably includes a spring biasing the latching member for latching the door in the closed position, the latching member being manually operable against the bias of the spring for unlatching the latching member for permitting opening of the door. The clamp assembly includes a transverse ledge, and the latching member includes a hook end portion and a finger-actuable end portion, the latching member being pivotally secured between its end portions to the door; and the spring biases the finger-actuable end portion for urging the hook to engage the ledge for latching the door in its closed position.

The door may preferably be opened to a first open position and to a second open position, each of such open door positions placing the light modifier element out of the path of the light beam. A hinge, which pivotally secures the door to the clamp assembly, includes a transverse pivot pin secured to the clamp assembly forwardly of the front edge, an arm projecting from the door pivotally secured to the pin and including a cam surface, a spring secured to the clamp assembly and biasing the cam surface for maintaining the door in the first open position when the door is pivoted to that open position. The arm preferably includes a second cam surface, the spring biasing the second cam surface for maintaining the door in the second further or fully open position when the door is pivoted to that second open position.

BRIEF DESCRIPTION OF THE DRAWINGS

The novel features believed to be characteristic of the invention, together with further advantages thereof, will be better understood from the following description considered in connection with the accompanying drawings in which a preferred embodiment of the present invention is illustrated by way of example. It is to be understood, however, that the drawings are for the purpose of illustration and description only and are not intended as a definition of the limits of the invention.

DETAILED DESCRIPTION OF THE PREFERRED EMBODIMENT

Figure 1:
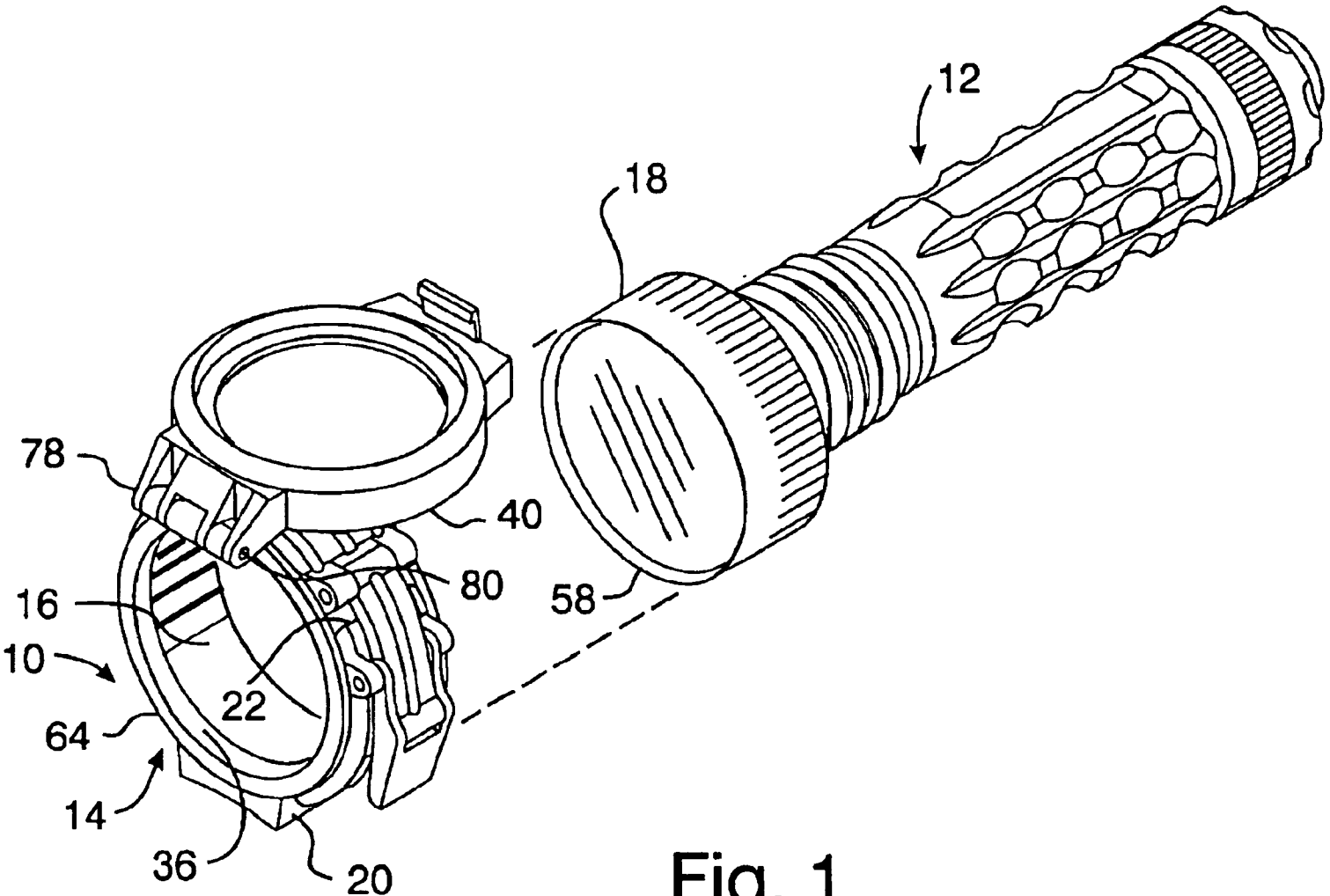
FIG. 1 is a front/side perspective view (in reduced scale as compared with FIGS. 2–15) of a preferred embodiment of a light beam modifier device according to the present invention, in exploded combination with a flashlight, the light beam modifier door shown in a fully flipped-open position.

Turning to FIG. 1, there is shown a preferred embodiment of a light beam modifier 10 for being mounted to the front of a light beam generator such as a flashlight 12. The light beam modifier 10 includes a clamp assembly 14 having a substantially cylindrical internal surface 16 for being clamped onto and about the front end bezel or head 18 of the flashlight 12 or of a weapon light. The clamp assembly 14 includes a generally cylindrical clamping member 20 (see also FIGS. 3, 5, 12, 14 and 15) constructed of a plastic material such as nylon or, for example, a resinous plastic material marketed by Du Pont de Nemours under the trademark ZYTEL®. The clamping member 20 is generally in the form of a tube having a longitudinal axis 21, and includes a longitudinal opening 22 defined between longitudinal ends 24, 26 of the substantially tubular clamping member 20. The clamping member's internal surface 28 generally conforms to but is slightly radially greater than the flashlight head 18; in the preferred embodiment where the internal surface 28 and the head 18 are generally cylindrical the diameter of the internal surface 28 is slightly larger than the outside diameter of the head 18. The clamping member's front edge 29 includes a radially inwardly projecting ledge 30 defining a circular opening having a diameter preferably slightly smaller than the outside diameter of the flashlight head 18.

Figure 13:
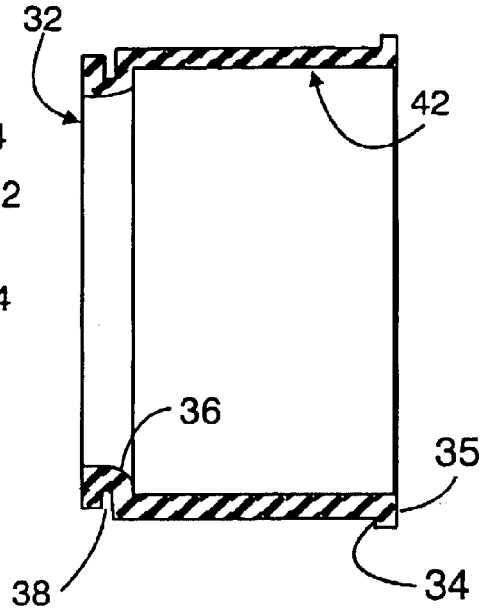
FIG. 13 is a cross-sectional elevation view of a clamp seal included in the light beam modifier preferred embodiment of FIG. 1.

The clamping member interior surface 28 is fitted with an elastomeric substantially tubular seal 32 (FIG. 13, see also FIG. 6), made for example of rubber or neoprene. The length of the seal 32 is preferably slightly greater than the length of the tubular clamping member 20 so as to slightly longitudinally extend from both the front edge 29 and the rear edge 33 of the clamping member 20. At its rear, the seal 32 includes a radially outwardly projecting shoulder 34 contacting and overhanging the rear edge 33 of the clamping member 20 to form a rear rim seal 35 thereabout. The forward edge of the seal 32 defines a radially inward ridge 36 having a radially outward recess 38 for mating with the clamping member radially inward ledge 30. In such manner, the fitted seal 32 is longitudinally held by the clamping member 20, while the seal's ridge 36 provides a stop and seal (both water-tight and light-tight) for the forward edge of the flashlight head 18, as well as providing a seal (both water-tight and light-tight) for the closed door 40 of the light beam modifier 10 as will be discussed later. The thickness of the elastomeric seal 32 is determined such that, when the clamping member 20 is installed on the flashlight head 18, the inner surface 42 of the seal 32 contacts the head 18 and the seal 32 is compressed between the clamping member's interior surface 28 and the outer surface of the head 18; i.e. the light beam modifier 10 is clamped about the front end portion of the flashlight 12.

Figure 12:
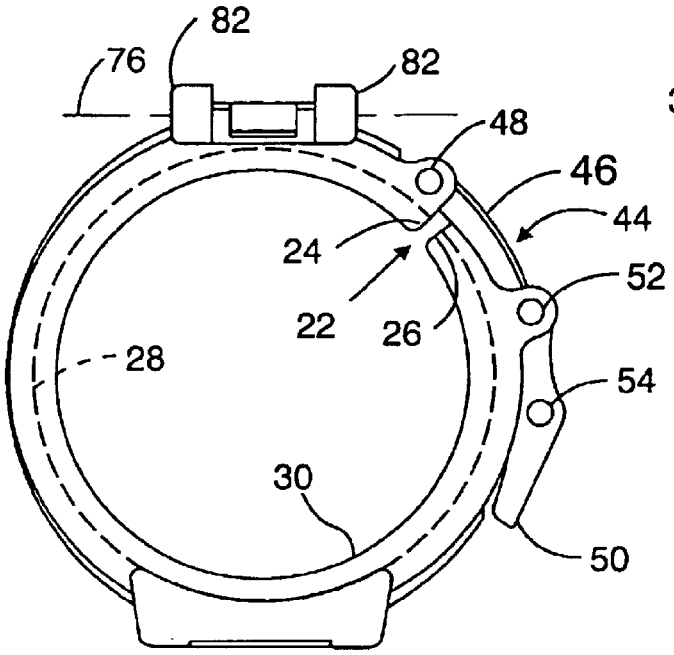
FIG. 12 is a front elevation view of the clamping member included in the light modifier preferred embodiment of FIG. 1, showing the clamping member in its latched or clamping configuration.

The clamping member 20 is provided with a latch 44 for relieving compression in the seal 32, to facilitate installation and removal of the light beam modifier 10 onto and from the flashlight 12. The latch 44 includes an arcuate pivot arm 46 pivotable about a first longitudinal pivot pin 48 secured to the clamping member 20 at one of its longitudinal ends 24 facing the opening 22. A finger-actuable latch member 50 is pivotable about a second longitudinal pivot pin 52 secured to the clamping member 20 in the vicinity of the other one of the clamping member ends 26 and spaced from the first pivot pin 48; in one example, the arcuate distance between the pins 48 and 52 was approximately 0.6 the arcuate length of the arm 46. The other end of the arcuate arm 46 is pivotably attached to the finger-actuable latch member 50 and is pivotable about a third longitudinal pivot pin 54 secured to the finger-actuable latch member 50. A preferred spatial relationship of the three pivot pins 48, 52, 54 is such that the arcuate arm 46, having an inner surface arc radius equal to or slightly greater than the radius of the outer surface of the tubular clamping member 20, will lie against or adjacent the outer surface of the clamping member 20 when the finger-actuable latch member 50 is urged into its fully closed position against or adjacent the outer surface of the clamping member 20 as shown in FIG. 12; in the example referred to above, the distance between the second pivot pin 52 and the third pivot pin 54 was approximately 0.4 the arcuate length of the arm 46.

Figure 14:
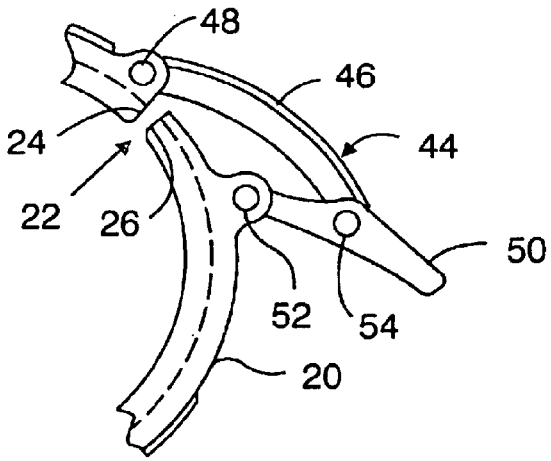
FIG. 14 is a fragmentary view of the clamping member of FIG. 12, shown unlatched.
Figure 15:
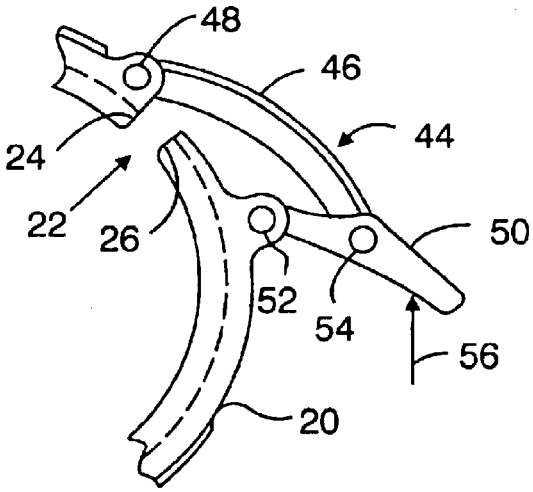
FIG. 15 is a fragmentary view of the clamping member of FIG. 12, shown in its unclamping configuration.

To install the light beam modifier device 10 on the flashlight 12, the user unlatches the normally closed latch 44 (its latched or closed position being shown in FIG. 12) by flipping open the finger-actuated latch member 50 to pivot about the pivot pin 52. This action causes the longitudinal pivot pin 54 to rotate upwardly and outwardly about the longitudinal pivot pin 52, in turn causing the arcuate lever arm 46 to pivot about pivot pin 48, as shown in FIG. 14. The user then inserts the flashlight bezel's front edge or rim 58 within the pliable rim seal 35 comprising the rear end of the clamp seal 32. As the light beam modifier 10 is slid onto the flashlight head 18, radial forces induced into the clamp seal 32 are transmitted to the clamping member 20 which, being resilient and unlatched, produces a greater separation between the clamping member's opposing longitudinal ends 24 and 26, increasing the effective diameter of the clamping member 20. The effective diameter of the resilient clamping member 20 may be further increased by upwardly urging the finger-actuable member 50 (indicated by the force arrow 56, see FIG. 15), which causes the arm 46 to urge the pivot pin 48 to move to the left as shown in FIG. 15, resulting in the clamping member longitudinal end 24 moving away from the end 26 and further increasing the width of the longitudinal opening 22. The user is thus permitted to easily slide the clamp assembly 14 onto the flashlight head 18, until the front rim 58 of the head 18 abuts the rear of the clamp seal's inwardly projecting ridge 36. At this point, the user urges the finger-actuatable latch 50 to pivot downwardly about the pivot pin 52 until the latch 44 is closed as shown in FIG. 12, whereupon the clamp seal 32 is compressably trapped between the head 18 and the clamp member 20, the clamping member 20 clamping the light beam modifier device 10 to the flashlight head 18.

The light beam modifier 10 may be removed from the flashlight head 18 by the user outwardly flipping open the finger-actuable latch member 50 to unlatch the latch 44, thereby substantially relieving compression in the clamp seal 32 and permitting the user to forwardly urge the light beam modifier 10 with respect to the head 18. Removal may be further facilitated by upwardly urging the finger-actuable latch member 50 (FIG. 15) to further increase the effective diameter of the clamping member 20.

Figure 2:
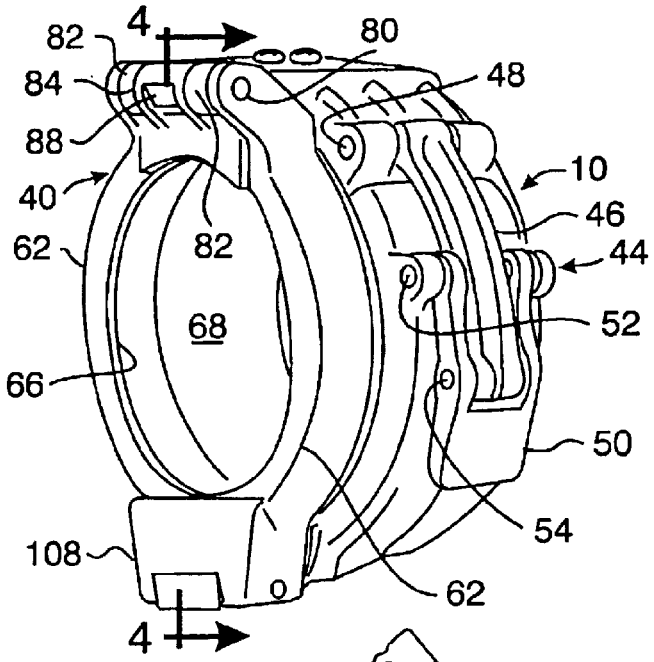
FIG. 2 is a front/side perspective view of the preferred embodiment of the light beam modifier device of FIG. 1, its door shown in its closed position.
Figure 4:
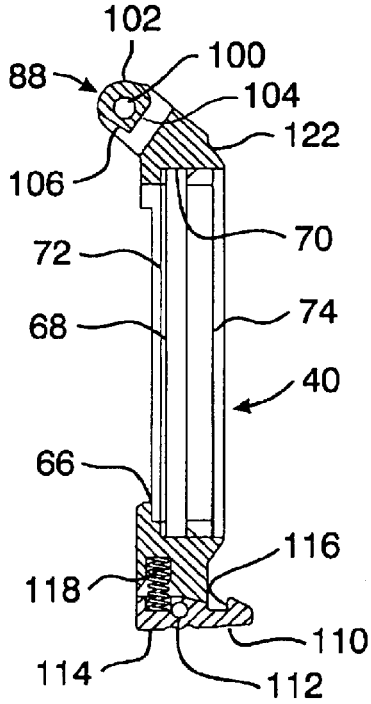
FIG. 4 is a cross-sectional elevation view of the light modifier door of the preferred embodiment of FIG. 2, taken along the line 4—4 of FIG. 2 in the direction of the appended arrows.
Figure 5:
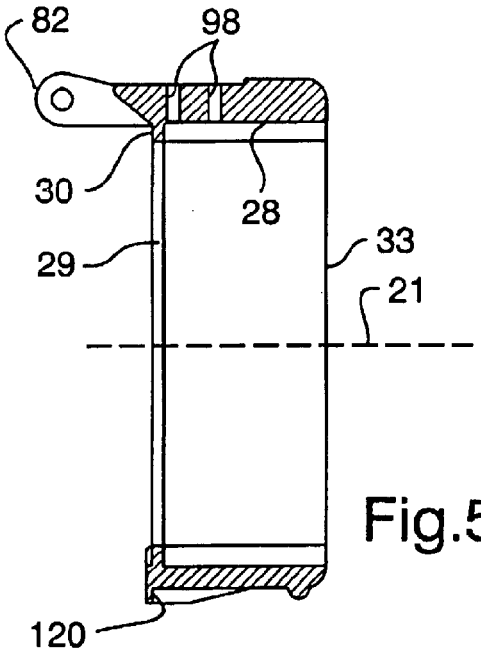
FIG. 5 is a cross-sectional elevation view of a clamping member of the light beam modifier preferred embodiment of FIG. 2, taken along the line 44 of FIG. 2 in the direction of the appended arrows.

Turning to FIGS. 2–11 along with FIG. 1, the light beam modifier 10 includes a door 40 pivotally secured to the clamping member 20 such that when the light beam modifier 10 is installed on the flashlight head 18 the door 40 may be placed in front of the head 18 in the path of the light beam and may be pivoted away from the front of the head 18 out of the path of the light beam. The door 40 comprises a substantially circular frame 62 of outside diameter or dimension sufficient to cover the front opening 64 of the clamping assembly 14. The frame 62 includes a central opening or window 66 for being interposed in the light path when the door 40 is in its closed position as shown in FIG. 2.

A light modifier element 68, such as an optical filter, an optical lens, a diffuser or an opaque cover, is held within the window 66 by the frame 62 such that the light modifier element 68 is interposed in the light path when the door 40 is in its closed position as shown in FIG. 2. In the preferred door embodiment 40 of FIG. 4, the light modifier element 68 is held by the frame 62 radially within a recess 70 circumferentially of the opening 66 and longitudinally held between an annular gasket 72 and a retaining ring 74, producing a watertight seal. Preferred examples of light modifying elements 68 include an optical filter for limiting the color of the light beam to produce a light beam of a particular color, such as blue, red, or infrared; an optical lens or lens system or translucent element for altering the light beam to produce a broader or more diffused light beam; and an opaque cover for completely blocking the light beam, as well as for permitting the flashlight 12 (or weapon light) to be stored without risk of damage to the front lens of the flashlight (or weapon light).

Alternative configurations for securing the light modifier element 68 to the frame 62 may be utilized; for example, the frame 62 may include threads about the circular window 66 for threadably mating with circumferential threads of the light modifier elements, permitting convenient interchangeability among different filters, lenses and covers. Where interchangeability is not desired, a particular light modifier element 68 may be permanently secured to the frame 62, such as by thermoplastic welding or adhesive techniques well known in the art.

The door 40 is pivotally secured to the clamping member 20, pivotable about a transverse axis 76 (see FIGS. 9 and 12) by hinge 78 which includes a transverse pivot pin 80 (see also FIGS. 1 and 2) held by two spaced forwardly projecting laterally spaced arms 82 of the clamping member 20. The hinge 78 further includes an arm 84 projecting from the door frame 62, preferably along a radius of the door 40, situated between the clamping member arms 82 and pivotally secured to the pivot pin 80. The door frame 62 may further include two additional arms 86, laterally outwardly of the respective clamping member arms 82, pivotally secured to and retaining the ends of the pivot pin 80.

Figure 3:
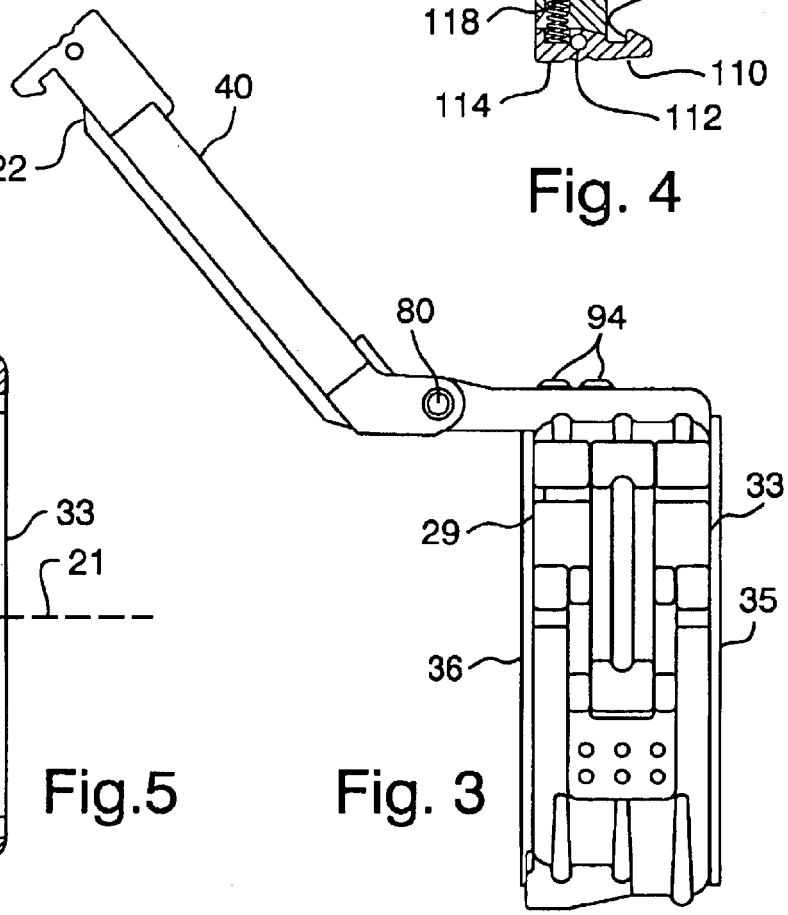
FIG. 3 is a side elevation view of the preferred embodiment of FIG. 2, shown with its door in a partially flipped-open position.
Figure 6:
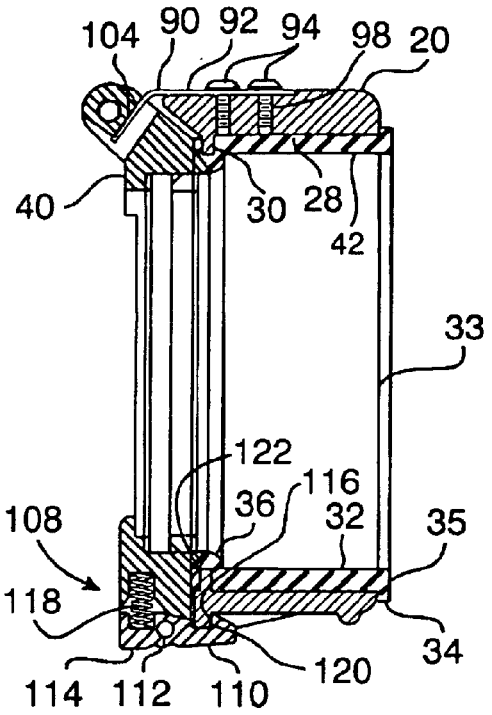
FIG. 6 is a cross-sectional elevation view (in enlarged scale) of the preferred embodiment of FIG. 2, taken along the line 4—4 of FIG. 2 in the direction of the appended arrows.
Figure 7:
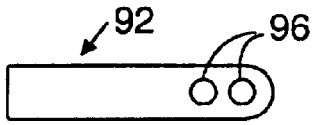
FIG. 7 is a top plan view of a flat spring included in the preferred embodiment of FIG. 6.
Figure 8:
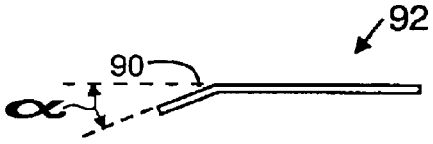
FIG. 8 is a side elevation view of the flat spring of FIG. 7.
Figure 10:
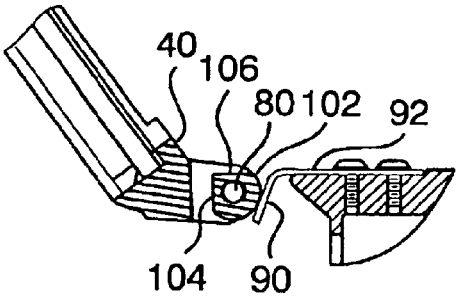
FIG. 10 is a fragmentary cross-sectional elevation view of the light beam modifier preferred embodiment as in FIG. 6 but with its door in a partially flipped-open position as in FIGS. 3 and 9.
Figure 9:
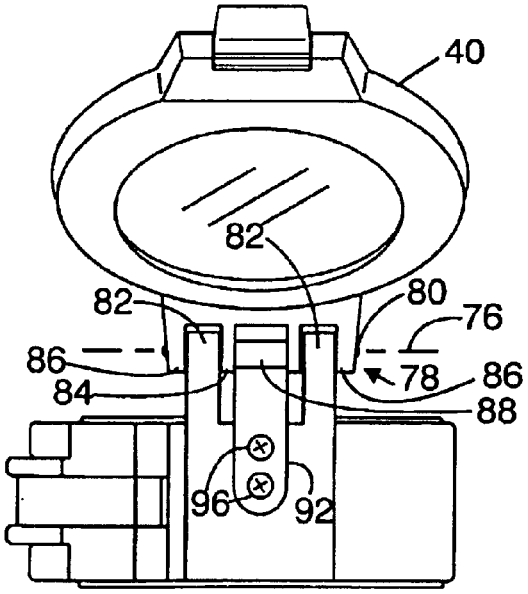
FIG. 9 is a top perspective view of the light modifier preferred embodiment with its door in a partially flipped-open position as in FIG. 3.
Figure 11:
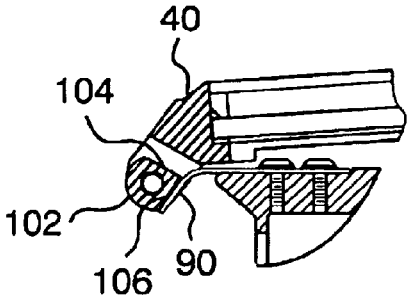
FIG. 11 is a fragmentary cross-sectional elevation view of the light beam modifier preferred embodiment as in FIG. 6 but with its door in a fully flipped-open position as in FIG. 1.

The door radial arm 84 includes a transverse cam surface 88 in contact with a bent end portion 90 of a flat spring 92 (FIGS. 7 and 8), the angle a of the bend in one example being approximately 22°. The flat spring 92 is secured to the clamping member 20, for example by two screws 94 through respective apertures 96 in the spring 92 and cooperating with mating threads in respective apertures 98 in the clamping member 20. The cam surface 88 of the radial arm 84 surrounds the transverse aperture 100 (FIG. 4) through which the hinge pivot pin 80 extends, and the cam surface 88 includes a substantially cylindrical surface 102 extending through an arc of approximately 180° between two substantially flat cam surfaces 104 and 106 having an included angle of approximately 90°. When the door is in its closed position as shown in FIG. 6, the cam first flat surface 104—which is at an angle of approximately 23° from the face of the door—is contacted by the flat spring end portion 90. When the user causes the door 40 to flip open, the door frame's radial arm 84 will rotate about the hinge pin 80 until the cylindrical cam surface 102 is contacted by the flat spring end portion 90 when the door 40 pivots to a first open position out of the path of the light beam, as represented in FIGS. 3, 9 and 10. The door may be maintained in this first position by the bias of the flat spring end portion 90 against the cylindrical cam surface 102, or the door may be further flipped rearwardly such that the cam cylindrical surface 102 travels along the spring end portion 90 until the second flat surface 106 of the cam portion 88 contacts the flat spring end portion 90, urging the door 40 to a second or further position out of the light beam path, in which second position the door 40 is preferably fully open as shown in FIGS. 1 and 11. The door is maintained in this fully open and "out of the way" position by the bias of the flat spring end 90 against the second flat cam surface 106. The user reverses the above procedure to cause the door 40 to assume its closed position as shown in FIGS. 2 and 6.

The preferred embodiment of the light beam modifier 10 is equipped with a door latch 108 (see FIGS. 4 and 6) including a hook member 110 pivotally secured to the door frame 62 diametrically opposite the door frame's radial arm 84. The latch hook member 110 is pivotable about transverse pivot pin 112 between a finger-actuable portion 114 of the hook member 110 and the hook portion 116 of the hook member 110. The finger-actuable portion 114 is radially outwardly (i.e. downwardly as shown in the drawing of FIG. 6) biased by compression spring 118, for pivotally urging the hook portion 116 into latching engagement with transverse latching ledge 120 (see FIGS. 5 and 6) of the clamping member 20, the latching ledge 120 situated diametrically opposite the clamping member arms 82, positively latching the door 40 to the clamp assembly 14 when the door 40 is closed and the latch hook member 110 is urged longitudinally rearwardly by the user. When the door 40 is closed and latched, the door frame's inner circular rim 122 (see FIGS. 3, 4 and 6) is urged against the front of the elastomeric seal ridge 36, producing a water-tight and light-tight seal between the door frame 62 and the clamp assembly 14.

To release the latch 108, the user presses the finger-actuable hook portion 114 radially (upwardly as shown in the drawing of FIG. 6) against the bias of the compression spring 118, causing the hook member 110 to pivot clockwise about the hook pivot pin 112. Such action results in the hook portion 116 being disengaged from the latching ledge 120, whereupon the door 40 is caused to be unlatched and opened by action of the flat spring end portion 90 upon the first flat surface 104 of the door frame radial arm 84. The door 40 may simultaneously be flipped open by the user, as previously described.

Thus, there has been described preferred a embodiment of a light beam modifier device for attachment to a light beam generator apparatus such as a flashlight or a weapon light. The light beam modifier includes an easily operable clamp for facilitating securement and removal of the light beam modifier device to and from the light generator. The device provides a positive locking closure between the flip-open door and the clamp, and further includes a spring hinge for permitting at least one and preferably two flip-open positions of the door out of the path of the light beam. Other embodiments of the present invention, and variations of the embodiment described herein, may be developed without departing from the essential characteristics thereof. Accordingly, the invention should be limited only by the scope of the claims listed below.

We claim:

1. A device for modifying a light beam emanating from the head of a light beam generator, the device comprising the combination of;

a clamp assembly including a substantially tubular member having a front edge and a rear edge and a longitudinal opening defined by longitudinal ends extending between said front and rear edges, a latch pivotally secured to said tubular member on opposing sides of said longitudinal opening and manually operable to a latched position maintaining the width of said opening for clamping said tubular member about the light beam generator head, said latch manually operable to an unlatched position permitting the width of said opening to be increased for unclamping said tubular member from the light beam generator head;

a door pivotally secured to said clamp assembly and including a light modifier element, said door being pivotable to a closed position placing said light modifier element in the path of a light beam generated by the light beam generator when said tubular member is clamped to the light beam generator head, said door being pivotable for maintaining said door in an open position with said light modifier element out of the path of the light beam; and a door latch including a manually actuable latching member on said door in cooperative latching relation with said clamp assembly for latching said door in said closed position to said clamp assembly, said door latch including a spring biasing said latching member for latching said door in said closed position, said latching member being manually actuable against the bias of said spring for unlatching said latching member for permitting opening of said door.

2. The device according to claim 1, wherein:

said latch of said clamp assembly is manually operable past said unlatched position for further increasing said width of said longitudinal opening.

3. The device according to claim 1, wherein:

said latch of said alarm assembly includes a pivot arm having first and second ends, said first end pivotally secured to a first longitudinal pivot pin secured to said tubular member, a finger-actuable member pivotally secured to a second longitudinal pivot pin secured to said tubular member, said first and second longitudinal pivot pins respectively situated on opposing sides of said longitudinal opening, said second end of said pivot arm pivotally secured to a third longitudinal pivot pin carried by said finger-actuable member.

4. The device according to claim 3, wherein:

said pivot arm describes an arc, the arc radius of the inner surface of said pivot arm being equal to or slightly greater than the radius of the exterior surface of said tubular member.

5. The device according to claim 1, further including:

an elastomeric seal fitted to the interior surface of said tubular member.

6. The device according to claim 5, wherein:

said elastomeric seal extends over said front edge of said tubular member for sealingly contacting said door when said door is in said closed position.

7. The device according to claim 1, wherein:

said clamp assembly includes a transverse ledge;

said latching member includes a hook end portion and a finger-actuable end portion, said latching member being pivotally secured between said end portions to said door; and said spring biases said finger-actuable end portion for urging said hook to engage said ledge for latching said door in said closed position.

8. The device according to claim 1, wherein:

said latch of said clamp assembly includes a pivot arm having first and second ends, said first end pivotally secured to said tubular member on one side of said longitudinal opening, a finger-actuable member pivotally secured to said tubular member on the other side of said longitudinal opening, said second end of said pivot arm pivotally secured to said finger-actuable member.

9. The device according to claim 8, wherein:

said latch of said clamp assembly across said longitudinal opening is manually operable past said unlatched position for further increasing said width of said longitudinal opening.

10. A device for modifying a light beam emanating from the head of a light beam generator, the device comprising the combination of:

a clamp assembly including a substantially tubular member having a front edge and a rear edge and a longitudinal opening defined by longitudinal ends extending between said front and rear edges, a latch pivotally secured to said tubular member on opposing sides of said longitudinal opening and manually operable to a latched position maintaining the width of said opening for clamping said tubular member about the light beam generator head, said latch manually operable to an unlatched position permitting the width of said opening to be increased for unclamping said tubular member from the light beam generator head; and a door pivotally secured to said clamp assembly and including a light modifier element, said door being pivotable to a closed position placing said light modifier element in the path of a light beam generated by the light beam generator when said tubular member is clamped to the light beam generator head, said door being pivotable for maintaining said door in a first open position with said light modifier element out of the path of the light beam, and said door is pivotable further for being maintained in a second open position past said first open position.

11. A device for modifying a light beam emanating from the head of a light beam generator, the device comprising the combination of:

a clamp assembly including a substantially tubular member having a front edge and a rear edge and a longitudinal opening defined by longitudinal ends extending between said front and rear edges, a latch on said tubular member across said longitudinal opening and manually operable to a latched position maintaining the width of said opening for clamping said tubular member about the light beam generator head, said latch manually operable to an unlatched position permitting the width of said opening to be increased for unclamping said tubular member from the light beam generator head;

a door including a light modifier element; and a hinge pivotally securing said door to said clamp assembly, said door being pivotable to a closed position placing said light modifier element in the path of a light beam generated by the light beam generator when said tubular member is clamped to the light beam generator head, said door being pivotable to an open position placing said light modifier element out of the path of the light beam, said hinge including a transverse pivot pin secured to said clamp assembly forwardly of said front edge, an arm projecting from said door pivotally secured to said pin and including a cam surface, a spring secured to said clamp assembly and biasing said cam surface for maintaining said door in said open position when said door is pivoted to said open position.

12. The device according to claim 11, wherein:

said arm includes a second cam surface, said spring biasing said second cam surface for maintaining said door in a further open position when said door is pivoted to said further open position.

13. The device according to claim 12, wherein:

said cam surface is substantially cylindrical; and said second cam surface is substantially flat.

14. The device according to claim 11, further including:

a door latch including a manually actuable latching member on said door in cooperative latching relation with said clamp assembly for latching said door in said closed position to said clamp assembly.

15. The device according to claim 14, wherein:

said door latch includes a spring biasing said latching member for latching said door in said closed position, said latching member being manually actuable against the bias of said spring for unlatching said latching member for permitting opening of said door.

16. The device according to claim 15, wherein:

said clamp assembly includes a transverse ledge;

said latching member includes a hook end portion and a finger-actuable end portion, said latching member being pivotally secured between said end portions to said door; and said spring biases said finger-actuable end portion for urging said hook to engage said ledge for latching said door in said closed position.

17. Light beam generator and modifier apparatus, comprising in combination:

a light beam generator having a head, for generating a light beam emanating from said head;

a clamp assembly including a substantially tubular member clamped about said head and having a front edge and a rear edge and a longitudinal opening defined by longitudinal ends extending between said front and rear edges, a latch pivotably secured to said tubular member on opposing sides of said longitudinal opening and manually operable to a latched position maintaining the width of said opening, said latch manually operable to an unlatched position permitting the width of said opening to be increased for unclamping said tubular member from said head;

a door pivotally secured to said clamp assembly and including a light modifier element, said door being pivotable to a closed position placing said light modifier element in the path of the light beam, said door being pivotable for maintaining said door in an open position with said light modifier element out of the path of the light beam; and a door latch including a latching member on said door in cooperative latching relation with said clamp assembly for latching said door in said closed position to said clamp assembly.

18. The apparatus according to claim 17, wherein:

said latch of said damn assembly is manually operable past said unlatched position for further increasing said width of said longitudinal opening.

19. The apparatus according to claim 17, wherein:

said latch of said clamp assembly includes a pivot arm having first and second ends, said first end pivotally secured to a first longitudinal pivot pin secured to said tubular member, a finger-actuable member pivotally secured to a second longitudinal pivot pin secured to said tubular member, said first and second longitudinal pivot pins situated on opposing sides of said longitudinal opening, said second end of said pivot arm pivotally secured to a third longitudinal pivot pin carried by said finger-actable member.

20. The apparatus according to claim 19, wherein:

said pivot arm describes an arc, the arc radius of the inner surface of said pivot arm being equal to or slightly greater than the radius of the exterior surface of said tubular member.

21. The apparatus according to claim 17, further including:

an elastomeric seal fitted to the interior surface of said tubular member.

22. The apparatus according to claim 21, wherein:

said elastomeric seal extends over said front edge of said tubular member and sealingly contacting said door when said door is in said closed position.

23. The apparatus according to claim 17, wherein:

said door latch includes a spring biasing said latching member for latching said door in said closed position, said latching member being manually actable against the bias of said spring for unlatching said latching member for permitting opening of said door.

24. The apparatus according to claim 23, wherein:

said clamp assembly includes a transverse ledge;

said latching member includes a hook end portion and a finger-actuable end portion, said latching member being pivotally secured between said end portions to said door; and said spring biases said finger-actuable end portion for urging said hook to engage said ledge for latching said door in said closed position.

25. Light beam generator and modifier apparatus, comprising in combination:

a light beam generator having a head, for generating a light beam emanating from said head;

a clamp assembly including a substantially tubular member clamped about said head and having a front edge and a rear edge and a longitudinal opening defined by longitudinal ends extending between said front and rear edges, a latch pivotably secured to said tubular member on opposing sides of said longitudinal opening and manually operable to a latched position maintaining the width of said opening, said latch manually operable to an unlatched position permitting the width of said opening to be increased for unclamping said tubular member from said head; and a door pivotally secured to said damn assembly and including a light modifier element, said door being pivotable to a closed position placing said light modifier element in the path of the light beam, said door being pivotable for maintaining said door in a first open position with said light modifier element out of the path of the light beam, and said door is pivotable further for being maintained in a second open position past said first open position.

26. Light beam generator and modifier apparatus, comprising in combination:

a light beam generator having a head, for generating a light beam emanating from said head;

a clamp assembly including a substantially tubular member clamped about said head and having a front edge and a rear edge and a longitudinal opening defined by longitudinal ends extending between said front and rear edges, a latch on said tubular member across said longitudinal opening and manually operable to a latched position maintaining the width of said opening, said latch manually operable to an unlatched position permitting the width of said opening to be increased for unclamping said tubular member from said head;

a door including a light modifier element; and a hinge pivotally securing said door to said clamp assembly, said door being pivotable to a closed position placing said light modifier element in the path of the light beam, said door being pivotable to an open position placing said light modifier element out of the path of the light beam, said hinge including a transverse pivot pin secured to said clamp assembly forwardly of said front edge, an arm projecting from said door pivotally secured to said pin and including a cam surface, a spring secured to said clamp assembly and biasing said cam surface for maintaining said door in said open position when said door is pivoted to said open position.

27. The apparatus according to claim 26, wherein:

said arm includes a second cam surface, said spring biasing said second cam surface for maintaining said door in a further open position when said door is pivoted to said further open position.

28. The apparatus according to claim 27, wherein:

said cam surface is substantially cylindrical; and said second cam surface is substantially flat.

29. A device for modifying a light beam emanating from the head of a light beam generator, the device comprising the combination of:

a substantially tubular member adapted to be secured about the light beam generator head;

a door pivotally secured to said tubular member and including a light modifier element, said door being pivotable to a closed position placing said light modifier element in the path of a light beam generated by the light beam generator when said tubular member is secured to the light beam generator head, said door being pivotable for maintaining said door in an open position with said light modifier element out of the path of the light beam; and a door latch including a latching member on said door in cooperative latching relation with said tubular member and a spring biasing said latching member for latching said door in said closed position, said latching member being manually actuable against the bias of said spring for unlatching said latching member for permitting opening of said door.

30. The device according to claim 29, wherein:

said tubular member includes a transverse ledge;

said latching member includes a hook end portion and a finger-actuable end portion, said latching member being pivotally secured between said end portions to said door; and said spring biases said finger-actuable end portion for urging said hook to engage said ledge for latching said door in said closed position.

31. A device for modifying a light beam emanating from the head of a light beam generator, the device comprising the combination of:

a substantially tubular member adapted to be secured about the light beam generator head;

a door including a light modifier element; and a hinge pivotally securing said door to said tubular member, said door being pivotable to a closed position placing said light modifier element in the path of a light beam generated by the light beam generator when said tubular member is secured to the light beam generator head, said door being pivotable to a first open position placing said light modifier element out of the path of the light beam, said door being pivotable to a second open position placing said light modifier out of the path of the light beam, said hinge including a transverse pivot pin secured to said tubular member, an arm projecting from said door pivotally secured to said pin and including a first cam surface and a second cam surface, a spring secured to said tubular member and biasing said first cam surface for maintaining said door in said first open position when said door is pivoted to said first open position, said spring biasing said second cam surface for maintaining said door in a said second open position when said door is pivoted to said second open position.

32. The device according to claim 31, wherein:

said first cam surface is substantially cylindrical; and said second cam surface is substantially flat.

33. A device for modifying a light beam emanating from the head of a light beam generator, the device comprising the combination of:

a clamp assembly including a substantially tubular member having a front edge and a rear edge and a longitudinal opening defined by longitudinal ends extending between said front and rear edges, a latch on said tubular member across said longitudinal opening and manually operable to a latched position maintaining the width of said opening for clamping said tubular member about the light beam generator head, said latch manually operable to an unlatched position permitting the width of said opening to be increased for unclamping said tubular member from the light beam generator head;

a door including a light modifier element; and a hinge pivotally securing said door to said clamp assembly, said door being pivotable to a closed position placing said light modifier element in the path of a light beam generated by the light beam generator when said tubular member is clamped to the light beam generator head, said door being pivotable to an open position placing said light modifier element out of the path of the light beam when said tubular member is clamped to the light beam generator, said hinge including an arm projecting from said door pivotally secured to said clamp assembly forwardly of said front edge, said arm including a cam surface, a spring secured to said clamp assembly and biasing said cam surface for maintaining said door in said open position when said door is pivoted to said open position.

34. The device according to claim 33, wherein:

said arm includes a second cam surface, said spring biasing said second cam surface for maintaining said door in a further open position when said door is pivoted to said further open position.

35. The device according to claim 34, wherein:

said cam surface is substantially cylindrical; and said second cam surface is substantially flat.

36. The device according to claim 33, further including:

a door latch including a manually actuable latching member on said door in cooperative latching relation with said clamp assembly for latching said door in said closed position to said clamp assembly.

37. The device according to claim 36, wherein:

said door latch includes a spring biasing said latching member for latching said door in said closed position, said latching member being manually actuable against the bias of said spring for unlatching said latching member for permitting opening of said door.

38. The device according to claim 37, wherein:

said clamp assembly includes a transverse ledge;

said latching member includes a hook end portion and a finger-actuable end portion, said latching member being pivotally secured between said end portions to said door; and said spring biases said finger-actuable end portion for urging said hook to engage said ledge for latching said door in said closed position.

39. A device for modifying a light beam emanating from the head of a light beam generator, the device comprising the combination of:

a substantially tubular member adapted to be secured about the light beam generator head;

a door including a light modifier element; and a hinge pivotally securing said door to said tubular member, said door being pivotable to a closed position placing said light modifier element in the path of the light beam, said door being pivotable to an open position placing said light modifier element out of the path of the light beam, said hinge including an arm projecting from said door pivotally secured to said tubular member forwardly thereof, said arm including a cam surface, a spring secured to said tubular member and biasing said cam surface for maintaining said door in a first open position when said door is pivoted to said open position.

40. The device according to claim 39, wherein:

said hinge includes a transverse pivot pin secured to said tubular member, and said arm is pivotably secured to said pivot pin.

41. The apparatus according to claim 39, wherein:

said arm includes a second cam surface, said spring biasing said second cam surface for maintaining said door in a further open position when said door is pivoted to said further open position.

42. The device according to claim 39, further including:

a door latch including a manually actuable latching member on said door in cooperative latching relation with said tubular member for latching said door in said closed position to said tubular member.

43. The device according to claim 42, wherein:

said door latch includes a spring biasing said latching member for latching said door in said closed position, said latching member being manually actuable against the bias of said spring for unlatching said latching member for permitting opening of said door.

44. The device according to claim 43, wherein:

said tubular member includes a transverse ledge;

said latching member includes a hook end portion and a finger-actuable end portion, said latching member being pivotally secured between said end portions to said door; and said spring biases said finger-actuable end portion for urging said hook to engage said ledge for latching said door in said closed position.

* * * * *

UNITED STATES PATENT AND TRADEMARK OFFICE

CERTIFICATE OF CORRECTION

PATENT NO. : 6,761,467 B2
DATED : July 13, 2004
INVENTOR(S) : John W. Matthews and Paul Y. Kim It is certified that error appears in the above-identified patent and that said Letters Patent is hereby corrected as shown below:

Column 3,
Line 34, “44” should be -- 4--4 --

Column 6,
Line 44, “a” should be -- α --

Column 8,
Line 31, “alarm” should be -- clamp --

Column 10,
Line 58, “damn” should be -- clamp --

Column 14,
Lines 51-52, there should be no new paragraph after “latching”

Signed and Sealed this

Sixteenth Day of November, 2004

JON W. DUDAS
*Director of the United States Patent and Trademark Office*